US008420223B2

(12) United States Patent
Hotta et al.

(10) Patent No.: US 8,420,223 B2
(45) Date of Patent: Apr. 16, 2013

(54) INSERT, METHOD FOR PRODUCING THE SAME, AND METHOD FOR PRODUCING LONG PRODUCT PROVIDED WITH THE SAME

(75) Inventors: Masatoshi Hotta, Kiyosu (JP); Tsuyoshi Shimizu, Kiyosu (JP)

(73) Assignee: Toyoda Gosei Co., Ltd., Kiyosu-Shi, Aichi-Ken (JP)

( * ) Notice: Subject to any disclaimer, the term of this patent is extended or adjusted under 35 U.S.C. 154(b) by 157 days.

(21) Appl. No.: 12/929,028

(22) Filed: Dec. 22, 2010

(65) Prior Publication Data

US 2011/0159311 A1 Jun. 30, 2011

(30) Foreign Application Priority Data

Dec. 25, 2009 (JP) ..... 2009-294508
Nov. 18, 2010 (JP) ..... 2010-257551

(51) Int. Cl.
*B32B 15/01* (2006.01)
*B21D 22/20* (2006.01)

(52) U.S. Cl.
USPC ..... 428/595; 29/6.1; 29/527.4; 72/199; 296/93; 296/146.1; 296/154

(58) Field of Classification Search ..... None
See application file for complete search history.

(56) References Cited

U.S. PATENT DOCUMENTS 4,339,860 A 7/1982 Hayashi
4,523,448 A * 6/1985 Sakai et al. ..... 72/185
5,576,511 A * 11/1996 Alhamad ..... 102/303
5,783,312 A * 7/1998 Laughman et al. ..... 428/573
6,532,787 B2 * 3/2003 Suitts ..... 72/185
6,684,574 B2 * 2/2004 Hayashi ..... 49/490.1
6,889,985 B2 * 5/2005 Bonds ..... 277/651
7,368,175 B2 * 5/2008 Neth ..... 428/573
7,517,590 B2 * 4/2009 Wagner ..... 428/573
7,886,487 B2 * 2/2011 Boutin ..... 49/490.1
2001/0001986 A1 * 5/2001 Alhamad ..... 169/49
2008/0263841 A1 * 10/2008 Stelzl ..... 29/6.1

FOREIGN PATENT DOCUMENTS

JP 55-8168 U 1/1980
JP 56-91931 A 7/1981
JP 6-106597 A 4/1994

* cited by examiner

*Primary Examiner* — Jennifer McNeil
*Assistant Examiner* — Jason Savage
(74) *Attorney, Agent, or Firm* — McGinn IP Law Group, PLLC

(57) ABSTRACT

An insert with a light weight per unit length, which is securely separable to obtain insert pieces, a method for producing such an insert, and a method for producing long products using such an insert. The insert includes a large number of insert pieces and joining parts formed by the application of a rolling operation and a tension force, and has a ladder-shaped configuration. Slits are defined between adjacent insert pieces, and include first slits, each having a large width in a longitudinal direction of the insert, and second slits, each having a width smaller than that of the first slits so as to be alternately formed. The joining parts include first joining parts, each having a small width in a width direction of the insert, and second joining parts, each having a width larger than that of the first joining parts so as to be alternately formed. The width ratio of the insert pieces, the first slits and the second slits in the longitudinal direction is determined to 100:(65~104):(24~53), whereas the width ratio of the first joining parts to the second joining parts in the width direction is determined to 20:(28~33).

11 Claims, 6 Drawing Sheets

INSERT, METHOD FOR PRODUCING THE SAME, AND METHOD FOR PRODUCING LONG PRODUCT PROVIDED WITH THE SAME

APPLICATION

This application is related to and claims priority from Japanese patent Applications No. 2009-294508 and No. 2010-257551 incorporated herein by reference.

BACKGROUND OF THE INVENTION

1. Field of the Invention

The present invention relates to an insert for use in a long product such as a weather strip for a motor vehicle, which is formed by extrusion and used to provide a seal between a door member such as a vehicle door, a trunk lid, etc., and an opening in a vehicle body, a method for producing such an insert, and a method for producing such a long product provided with such an insert.

2. Description of Related Art

As shown in FIG. 1, a long product such as a weather strip 10 for a motor vehicle is attached to a periphery around an opening in a vehicle body. The weather strip 10 has a trim portion 12 with a generally U-shaped cross-section, as a base portion for attachment to a flange, and a tubular seal portion 14 for contacting a door member and providing a seal between the vehicle body and the door member. An insert 16 produced by subjecting a band-shaped metallic plate to punching is embedded in the trim portion 12 for enlarging the gripping force of the trim portion 12 (see Publication of Japanese Utility model application No. sho 55-8168, for example).

As shown in FIG. 2, the insert 16 has a ladder-like configuration, and is composed of a large number of insert pieces 18, each extending in a widthwise direction of the insert 16. The insert pieces 18 are joined to each other in their both ends with joining parts extending in a longitudinal direction. The joining parts include first joining parts 20, each having a smaller width so as to be readily breakable, and second joining parts 22, each having a larger width so as to be difficult to break. The first joining parts 20 and the second joining parts 22 are alternately arranged in a longitudinal direction of the insert 16. The first joining parts 20 and the insert pieces 18 define first slits 24, whereas the second joining parts 22 and the insert pieces 18 define second slits 26.

When the long product is produced by feeding the insert 16 to an extruder and forming a covering layer of a rubber-like elastic body around the insert 16, the joining parts of the insert 16 remain joined for facilitating taking up of the same. But, when the long product is used to be attached along corners of the flange, etc., the joining parts are separated for enhancing the flexibility of the trim portion 12.

And after extrusion, the first joining parts 20 of the insert 16 are broken and separated, and consequently, there exist in the trim portion 12, a plurality of pairs of insert pieces 18, each being joined on an upper side and a lower side thereof with the second joining parts 22, thereby defining the second slits 26.

The insert 16 disclosed in this publication, is formed by subjecting a band-shaped metallic plate to punching, etc. so that parts of the metallic plate corresponding to the first slits 24 and the second slits 26 become wasted to produce metal scrap, thereby increasing the production costs. In addition, the thickness of the first joining parts 20 is identical to that of the remaining parts so that they have been difficult to be broken. The flexibility of the trim portion 12 is improved by breaking all joining parts, but in order to bend and break all joining parts, a long process is required to deteriorate productivity. And where the width of the joining parts is made smaller for facilitating braking thereof, there occurs the problem that the joining parts may break during the extruding step of the covering layer.

In order to overcome this problem, as shown in FIG. 3, first cut lines 28 with a long length and second cut lines 30 with a short length are alternately formed in a belt-shaped metallic plate 32 with uncut portions remained on both side ends thereof. In addition, side cut lines 34 are formed along side edges of the belt-shaped metallic plate 32. Thereafter, the uncut portions adapted to form the joining parts are subjected to rolling. As a result, openings of the long first cut lines 28, the short second cut lines 30 and the side cut lines 34 are enlarged to form first slits 36 and second slits 38, each having a width of C in FIG. 4, whereas uncut portions define first joining parts 40, each having a width of A shown in FIG. 4, and second joining parts 42, each having a width of B shown in FIG. 4 (see Publication of Japanese Patent application No. Sho56~91931, for example).

In this case, as shown in FIG. 4. in a resultant insert 44, only the uncut portions are rolled in a longitudinal direction and elongated by a rolling amount so that the width of the first slits 36 and that of the second slits 38 are approximately identical to each other, and have not been enlarged furthermore. Where the rolling amount is increased, there occurs the problem that the insert 44 may be broken upon extruding the covering layer. For these reasons, the ratio of the width of the insert pieces 46 (D in FIG. 4) in the insert 44 becomes large, and the number of the insert pieces 46 per unit length increases so that the weight of the insert member 44 enlarges not to respond to the demand to reduce the weight of vehicle bodies.

SUMMARY OF THE INVENTION

It is an object of the present invention to provide an insert with a light weight per unit length, which is prevented from being separated upon extruding long products and is capable of securely separating to obtain insert pieces after extrusion, a method for producing such an insert, and a method for producing long products using such an insert.

In order to achieve the above-described object, in accordance with a first aspect of the present invention, an insert formed by processing a band-shaped metallic plate and adapted to be embedded within a long product includes a large number of insert pieces, each having a rectangular configuration and extending in a width direction of the band-shaped metallic plate. The insert pieces are joined at both sides thereof with joining parts in a longitudinal direction of the band-shaped metallic plate into a ladder-shaped configuration, and a rolling operation and a tensioning force are applied to the joining parts.

Slits are defined between adjacent insert pieces, and include first slits, each having a large width in a longitudinal direction of the insert, and second slits, each having a smaller width in the longitudinal direction than that of the first slits. The first slits and the second slits are alternately arranged in the longitudinal direction. The joining parts include first joining parts, each being formed on a side of each of the first slits and having a small width in a width direction of the insert, and second joining parts, each being formed on a side of each of the second slits, and having a larger width in the width direction than that of the first joining parts, and the first joining parts and the second joining parts are alternately formed in the longitudinal direction, The width ratio of the insert pieces, the first slits and the second slits in the longitudinal direction is determined to 100:(65~104):(24~53), and the width ratio of the first joining parts to the second joining parts in the width direction is determined to 20:(28~33).

In accordance with the first aspect, the insert is formed of a band-shaped metallic plate into a ladder-shaped configuration such that a large number of insert pieces, each having a rectangular configuration, extend in a width direction of the band-shaped metallic plate, and the insert pieces are joined at both sides thereof with joining parts in a longitudinal direction of the band-shaped metallic plate. Therefore, when the insert with a ladder-shaped configuration is fed to an extruder adapted to produce long products, and extruded therein, ends of the insert pieces are not irregularly bent, and smooth extrusion can be performed.

The rolling operation and the tension force are applied to the joining parts and slits so as to have a thickness and width with specific ratios, whereby the slits can be formed without producing metal scrap during the processing operation of the band-shaped metallic plate. In addition, the first joining parts can be formed thinner and narrower as compared with the insert pieces so that the insert can be readily separated at the first joining parts after the insert is extruded and embedded within the long product. Furthermore, by virtue of the insert pieces, each being bent to a U-shaped cross-section, after the insert is embedded within the long product, the gripping force of a trim portion as a base portion thereof against the flange can be enlarged.

The first slits, each having a large width in the longitudinal direction of the insert, and the second slits, each having a width smaller than that of the first slits, in the longitudinal direction, are alternately arranged between adjacent insert pieces. By virtue of the first slits, each having a larger width, the number of the insert pieces per unit length can be decreased, and consequently, the weight of the insert can be reduced, thereby contributing to the reduction in weight of the vehicle body.

The first joining parts, each being formed on a side of each of the first slits and having a small width in the width direction of the insert, and the second joining parts, each being formed on a side of each of the second slits and having a width larger than that of the first joining parts in the width direction, are alternately formed in the longitudinal direction. With this arrangement, after the insert is extruded and embedded within the long product, the insert can be readily separated at only first joining parts, each having a smaller thickness and a smaller width, as compared with the insert pieces, and consequently, the insert can be separated with two insert pieces joined to each other. Therefore, the flexibility of the long product and the rigidity of the insert can be effected.

The width ratio of the insert pieces, the first slits and the second slits in the longitudinal direction is determined to 100:(65~104):(24~53). With this arrangement, the width of the first slits can be enlarged to decrease the number of the insert pieces per unit length, reduce the weight of the insert and contribute to the reduction in weight of the vehicle body. The ratio of the width of the first slits to that of the insert pieces in the longitudinal direction is determined to 65~104 to 100. Where the width ratio of the first slits is less than 65, the number of the insert pieces per unit length cannot be decreased so that the weight of the insert cannot be reduced. Where the width ratio of the first slits exceeds 104, the rigidity of the insert lowers so that the gripping force of the trim portion as the base portion of the long product, in which the insert is embedded, decreases.

The width ratio of the second slits to the insert pieces in the longitudinal direction is determined to 24~53 to 100. Where the width ratio of the second slits is less than 24, the number of the insert pieces per unit length cannot be decreased. Where the width ratio of the first slits exceeds 53, the strength of the second joining parts of the insert lowers so that the second joining parts may be separated during the separating step of the first joining parts.

The width ratio of the first joining parts to the second joining parts in the width direction is determined to 20:(28~33). Therefore, the first joining parts can be readily broken during the separating step of the insert so that the insert can be separated with two insert pieces joined to each other without being separated at the second joining parts. Where the width ratio of the second joining parts in the width direction is less than 28, the strength of the second joining parts of the insert lowers so that the second joining parts may break during the separating step of the first joining parts. Where the width ratio of the second joining parts in the width direction exceeds 33, the width of the second slits is difficult to enlarge during the rolling operation so that the number of the insert pieces per unit length cannot be decreased, and consequently, the weight of the insert cannot be reduced.

In accordance with a second aspect of the present invention, the width ratio of the insert pieces, the first slits and the second slits in the longitudinal direction is determined to 100:(75~95):(32~43), and the width ratio of the first joining parts to the second joining parts in the width direction is determined to 20:(28~33).

With this arrangement, since the width ratio of the insert pieces, the first slits and the second slits in the longitudinal direction is determined to 100:(75~95):(32~43), the obtained insert can exhibit a sufficient gripping force against long products, and effect the reduction in weight of the insert.

The width ratio of the first slits to the insert pieces in the longitudinal direction is determined to 75~95:100. In this ratio, the number of the insert pieces per unit length can be decreased, the rigidity of the insert can be securely effected, and the gripping force of the trim portion as a base portion of the long product, in which the insert is embedded, can be securely effected.

The width ratio of the second slits to the insert pieces in the longitudinal direction is determined to 32~43:100. In this ratio, the number of the insert pieces per unit length can be decreased, the strength of the second joining parts of the insert can be securely effected so that the separation of the second joining parts can be securely prevented during the separating step of the first joining parts.

The width ratio of the first joining parts to the second joining parts in the width direction is determined to 20:(28~33), the lowering of the rigidity of the insert and the separation thereof can be prevented during the extruding step, and the extruding step can be performed at a high speed.

In accordance with a third aspect of the present invention, the ratio of the thickness of the insert pieces to that of the joining parts is determined to 20:(10~13).

With this arrangement, since the ratio of the thickness of the insert pieces to that of the joining parts is determined to 20:(10~13), the insert can be readily separated at the first joining parts after the extruding step with the insert embedded within the long product. And since the rolling operation and the tension force are applied to elongate the joining parts in the longitudinal direction, the width of the first slits can be made larger than that of the second slits.

Where the ratio of the thickness of the joining parts is less than 10, the strength of the joining parts becomes short so that the first joining parts may be separated in the extrusion step, and the second joining parts may be separated in the separation step of the insert. Where the ratio of the thickness of the joining parts exceeds 13, the strength of the joining parts becomes great so that the first joining parts may not be separated in the separating step of the insert.

In addition, where the ratio of the thickness of the joining parts is less than 10, the rolling operation is performed excessively so that the joining parts may be readily separated and may be broken in the steps other than the required step. Where the ratio of the thickness of the joining parts exceeds 13, the weight of the vehicle body is not reduced.

In accordance with a fourth aspect of the present invention, in the method for producing an insert formed by processing a band-shaped metallic plate so as to include insert pieces, each having a rectangular configuration and defining slits with adjacent insert pieces, and joining parts joining both side ends of the insert pieces into a ladder-shaped configuration, and adapted to be embedded within a long product, long cut lines and short cut lines are formed alternately in a longitudinal direction of the band-shaped metallic plate with the exception of side edges thereof so as to extend in a width direction thereof.

The band-shaped metallic plate including the long cut lines and the short cut lines is fed to rolling rolls and take-up rolls, and a rolling operation and a tension force are applied to the side edges of the band-shaped metallic plate in which the cut lines are not formed, thereby forming slits between adjacent insert pieces along with joining parts. The slits include first slits, each having a large width in a longitudinal direction of the insert, and second slits, each having a width smaller than that of the first slits in the longitudinal direction, such that the first slits and the second slits are alternately arranged in the longitudinal direction. The joining parts include first joining parts, each being formed on a side of each of the first slits and having a small width in a width direction of the insert, and second joining parts, each being formed on a side of each of the second slits and having a width larger than that of the first joining parts in the width direction. And the first joining parts and the second joining parts are alternately formed in the longitudinal direction with a tension force generated due to difference in rotation speed between the rolling rolls and the take-up rolls such that the width ratio of the insert pieces, the first slits and the second slits in the longitudinal direction is determined to 100:(65~104):(24~53), and the width ratio of the first joining parts to the second joining parts in the width direction is determined to 20: (28~33).

With this method, long cut lines and short cut lines are alternately formed in the band-shaped metallic plate with the exception of side edges thereof so as to extend in a width direction thereof, the band-shaped metallic plate including the long cut lines and the short cut lines is fed to rolling rolls and take-up rolls, and a rolling operation and a tension force are applied to the side edges of the band-shaped metallic plate in which the cut lines are not formed, thereby forming slits between adjacent insert pieces. Therefore, by rolling the joining parts with the rolling rolls, and taking up the same with the take-up rolls, the slits can be formed without producing metal scrap upon processing the band-shaped metallic plate. In addition, the joining parts can be formed thinner than the remaining parts so that the thinner joining parts can be readily separated after the extrusion of the long product in which the insert is embedded.

The slits include first slits, each having a large width in a longitudinal direction of the insert, and second slits, each having a width smaller than that of the first slits in the longitudinal direction, and they are alternately formed. Therefore, by virtue of the first slits, each having a larger width, the insert including a smaller number of insert pieces per unit length can be produced so that the weight of the insert can be reduced, thereby contributing to the reduction in weight of the vehicle body.

The joining parts include first joining parts, each being formed on a side of each of the first slits and having a small width in a width direction of the insert, and second joining parts, each being formed on a side of each of the second slits and having a width larger than that of the first joining parts in the width direction, and they are alternately formed in the longitudinal direction of the insert with a tension force generated due to difference in rotation speed between the rolling rolls and the take-up rolls. Therefore, the first joining parts can be readily separated after the extrusion of the long product in which the insert is embedded so that the separation of the insert can be performed with two insert pieces joined. Consequently, the flexibility of the long product and the rigidity of the insert can be both effected.

Since the width ratio of the insert pieces, the first slits and the second slits in the longitudinal direction is determined to 100:(65~104):(24~53), the width of the first slits can be made large to decrease the number of the insert pieces per unit length so that the weight of the insert can be reduced, thereby contributing to the reduction in weight of the vehicle body.

The width ratio of the first slits to the insert pieces in the longitudinal direction is determined to 65~104:100. Where the width ratio of the first slits is less than 65, the number of the insert pieces per unit length cannot be decreased so that the weight of the insert cannot be reduced. Where the width ratio of the first slits exceeds 104, the rigidity of the insert lowers so that the gripping force of the trim portion as the base portion of the long product, in which the insert is embedded, decreases.

The width ratio of the second slits to the insert pieces in the longitudinal direction is determined to 24~53:100. Where the width ratio of the second slits is less than 24, the number of the insert pieces per unit length cannot be decreased. Where the width ratio of the first slits exceeds 53, the strength of the second joining parts of the insert lowers so that the second joining parts may be separated during the separating step of the first joining parts.

Since the insert is formed such that the width ratio of the first joining parts to the second joining parts in the width direction is determined to 20:(28~33), the first joining parts can be readily separated so that the insert can be separated with two insert pieces joined to each other.

In accordance with a fifth aspect of the present invention, the insert is formed such that the width ratio of the insert pieces, the first slits and the second slits in the longitudinal direction is determined to 100:(75~95):(32~43), and the width ratio of the first joining parts to the second joining parts in the width direction is determined to 20:(28~33).

With this arrangement, since the width ratio of the insert pieces, the first slits and the second slits in the longitudinal direction is determined to 100:(75~95):(32~43), the long product including the insert can exhibit a sufficient gripping force upon producing the long product using the insert, and the reduction in weight of the insert can be effected.

The width ratio of the first slits to that of the insert pieces in the longitudinal direction is determined to 75~95:100. In this ratio, the number of the insert pieces per unit length can be decreased, the rigidity of the insert can be securely effected, and a great gripping force of the trim portion as a base portion of the long product can be effected after the insert is embedded within the long product.

The width ratio of the second slits to the insert pieces is determined to 32~43:100. In this ratio, the number of the insert pieces per unit length can be decreased, and the strength of the second joining parts of the insert can be securely effected so that the separation of the second joining parts can be securely prevented during the separating step of the first joining parts.

Since the insert is formed such that the width ratio of the first joining parts to the second joining parts in the width direction is determined to 20:(28~33), the lowering of the rigidity of the insert can be prevented during extrusion, and the extruding step can be performed at a high speed.

In accordance with a sixth aspect of the present invention, the insert is formed such that the ratio of the thickness of the insert pieces to that of the joining parts is determined to 20:(10~13).

With this method, since the insert is formed such that the ratio of the thickness of the insert pieces to that of the joining parts is determined to 20:(10~13), the joining parts are rolled in the longitudinal direction by applying a rolling operation and a tension force so that the width of the first slits can be made larger than that of the second slits. In addition, upon producing the long product, the insert can be readily separated at the first joining parts after the long product is extruded with the insert embedded therein.

Where the ratio of the thickness of the joining parts is less than 10, the strength of the joining parts becomes short so that the first joining parts may be separated in the extrusion step, and the second joining parts may be separated in the separation step of the insert. Where the ratio of the thickness of the joining parts exceeds 13, the strength of the joining parts becomes large so that the first joining parts may not be separated in the separating step of the insert.

In addition, where the ratio of the thickness of the joining parts is less than 10, the rolling operation is performed excessively so that the joining parts may be readily separated and may be broken in the steps other than the step requiring separation of the insert. Where the ratio of the thickness of the joining parts exceeds 13, the weight of the vehicle body is not reduced.

In accordance with a seventh aspect of the present invention, in the producing method of the insert, the insert is taken up with a tension force of 200 through 250 N in the rolling rolls by increasing the feeding speed of the take-up rolls greater than that of the rolling rolls.

With this arrangement, since the insert is taken up with a tension force of 200 through 250 N in the rolling rolls by increasing the feeding speed of the take-up rolls greater than that of the rolling rolls, the width of the first slits and that of the second slits in the longitudinal direction can be greatly enlarged when the joining parts are rolled. Where the tension force is less than 200 N, the first slits do not open sufficiently, and when the tension force exceeds 250N, the first slits open excessively.

In accordance with an eighth aspect of the present invention, the producing method of a long product includes an insert-processing step of processing a band-shaped metallic plate to form a metallic insert, an extruding step of feeding the metallic insert to an extruder and covering the insert with a rubber-like elastic material such that the insert is embedded within the long product, and an insert-separating step of separating insert pieces of the insert.

In the insert-processing step, long cut lines and short cut lines are formed alternately in the band-shaped metallic plate with the exception of side edges thereof so as to extend in a width direction thereof, the band-shaped metallic plate including the long and short cut lines is fed to rolling rolls and take-up rolls. A rolling operation and a tension force are applied to the side edges of the band-shaped metallic plate in which the cut lines are not formed, thereby forming slits between adjacent insert pieces and joining parts. The slits include first slits, each having a large width in a longitudinal direction of the metal insert, and second slits, each having a width smaller than that of the first slits in the longitudinal direction such that the first slits and the second slits are alternately formed in the longitudinal direction, and the joining parts include first joining parts, each being formed on a side of each of the first slits and having a small width in a width direction of the insert, and second joining parts, each being formed on a side of each of the second slits and having a width larger than that of the first joining parts in the width direction such that the first joining parts and the second joining parts are alternately formed in the longitudinal direction with a tension force generated due to difference in rotation speed between the rolling rolls and the take-up rolls. The width ratio of the insert pieces, the first slits and the second slits in the longitudinal direction is determined to 100:(65~104):(24~53), whereas the width ratio of the first joining parts to the second joining parts in the width direction is determined to 20: (28~33).

In the extruding step, the insert is fed to the extruder and covered with the rubber-like elastic material to form a covering layer such that the insert is embedded within a base portion of the long product, and the insert covered with the covering layer is fed to the insert-separating step.

In the insert-separating step, the insert is separated at positions corresponding to the first slits such that two insert pieces join to each other.

With the eighth aspect of the present invention, in the insert-processing step, long cut lines and short cut lines are formed alternately in the band-shaped metallic plate with the exception of side edges thereof so as to extend in a width direction thereof, the band-shaped metallic plate including the long and short cut lines is fed to rolling rolls and take-up rolls, and a rolling operation and a tension force are applied to the side edges of the band-shaped metallic plate in which the cut lines are not formed, thereby forming slits between adjacent insert pieces. By rolling the joining parts with the rolling rolls, and taking-up the same with the take-up rolls, the slits can be formed without producing metal scrap upon processing the band-shaped metallic plate. In addition, the joining parts can be formed thinner that the remaining parts so that the thinner joining parts can be readily separated after the extrusion of the long product with the insert embedded therein.

The slits include first slits, each having a large width in a longitudinal direction of the insert, and second slits, each having a width smaller than that of the first slits in the longitudinal direction, and they are alternately formed. Therefore, by virtue of the first slits, each having a larger width, the insert including a smaller number of insert pieces per unit length can be produced so that the weight of the insert can be reduced, and the weight of the long product can be reduced, thereby contributing to the reduction in weight of the vehicle body.

The joining parts include first joining parts, each being formed on a side of each of the first slits and having a small width in a width direction of the insert, and second joining parts, each being formed on a side of each of the second slits and having a width larger than that of the first joining parts in the width direction, and they are alternately formed in the longitudinal direction of the insert with a tension force generated due to difference in rotation speed between the rolling rolls and the take-up rolls. Therefore, the first joining parts can be readily separated after the extrusion of the long product with the insert embedded therein so that the separation of the insert can be performed with two insert pieces joined.

Consequently, the flexibility of the long product and the gripping force of the base portion can be both improved.

Since the width ratio of the insert pieces, the first slits and the second slits in the longitudinal direction is determined to 100:(65~104):(24~53), the width of the first slits can be made large to decrease the number of the insert pieces per unit length so that the weight of the insert can be reduced, thereby reducing the weight of the long product, and contributing to the reduction in weight of the vehicle body.

The width ratio of the first slits to the insert pieces in the longitudinal direction is determined to 65~104:100. Where the width ratio of the first slits is less than 65, the number of the insert pieces per unit length cannot be decreased so that the weight of the insert cannot be reduced. Where the width ratio of the first slits exceeds 104, the rigidity of the insert lowers so that the gripping force of the trim portion as the base portion of the long product, in which the insert is embedded, lowers.

The width ratio of the second slits to the insert pieces in the longitudinal direction is determined to 24~53:100. Where the width ratio of the second slits is less than 24, the number of the insert pieces per unit length cannot be decreased. Where the width ratio of the second slits exceeds 53, the strength of the second joining parts of the insert lowers so that the second joining parts may be separated during the separating step of the first joining parts.

Since the insert is formed such that the width ratio of the first joining parts to the second joining parts in the width direction is determined to 20:(28~33), the first joining parts can be readily broken so that the insert can be separated with two insert pieces joined to each other. Where the width ratio of the second joining parts to that of the first joining parts is less than 28, the strength of the second joining parts of the insert lowers, as compared to that of the first joining parts so that the second joining parts may be separated during the separating step of the first joining parts. Where the width ratio of the second joining parts exceeds 33, the width of the second slits reduces so that the number of the insert pieces per unit length cannot be decreased, and accordingly the reduction in weight of the insert is not effected.

In the extruding step, the insert is fed to the extruder and, covered with the rubber-like elastic material to form the covering layer such that the insert is embedded within the base portion of the long product, and the insert covered with the covering layer is fed to the insert-separating step, and in the insert-separating step, the insert is separated at positions corresponding to the first slits such that two insert pieces join to each other. With this method, the gripping force of the base portion of the long product against the flange is improved, and the flexibility of the long product can be also improved.

In accordance with a ninth aspect of the present invention, the insert is formed such that the width ratio of the insert pieces, the first slits and the second slits in the longitudinal direction is determined to 100:(75~95):(32~43), and that the width ratio of the first joining parts to the second joining parts in the width direction is determined to 20:(28~33).

With this method, since the width ratio of the insert pieces, the first slits and the second slits in the longitudinal direction is determined to 100:(75~95):(32~43), long products produced using such the inserts exhibit a sufficient gripping force, and the weight of the long products can be reduced.

The width ratio of the first slits to the insert pieces in the longitudinal direction is determined to 75~95:100. In this ratio, the number of the insert pieces per unit length can be reduced, and the rigidity of the insert can be securely effected, whereby the gripping force of the trim portion as the attaching base portion of the long product in which the metal insert is embedded is ensured.

The width ratio of the second slits to the insert pieces in the longitudinal direction is determined to 32~43:100. In this ratio, the number of the insert pieces per unit length can be decreased, and the strength of the second joining parts of the insert can be securely effected, whereby the separation of the second joining parts during the separating step of the first joining parts can be surely prevented.

Since the width ratio of the first joining parts to the second joining parts in the width direction is determined to 20:(28~33), the lowering of the rigidity of the insert, and the separation thereof during the extruding step can be prevented, and the extruding step can be performed at a high speed.

In accordance with a tenth aspect of the present invention, the long product is formed such that the insert is formed to determine the ratio of the thickness of the insert pieces to that of the joining parts to 20:(10~13).

With this method, since the metal insert is formed such that the ratio of the thickness of the insert pieces to that of the joining parts is determined to 20:(10~13), upon elongating the joining parts in the longitudinal direction with a rolling operation and a tension force, the width of the first slits can be made larger that that of the second slits. And, upon producing the long products, the first joining parts can be readily separated after the extruding step of the long products in which the inserts are embedded.

In addition, when the ratio of the thickness of the joining parts is less than 10, the rolling operation is performed excessively so that the joining parts may be readily separated in other steps than the step requiring the separation of the insert pieces, whereas when the ratio of the thickness of the joining parts exceeds 13, the weight of the vehicle bodies cannot be reduced.

In accordance with an eleventh aspect of the present invention, in the method for producing the long product, the long product is a weather strip adapted to provide a seal around a periphery of an opening portion in a vehicle body.

With this method, since the long product is a weather strip adapted to provide a seal around the periphery of the opening portion in the vehicle body, the base portion of the weather strip, in which a metallic insert is embedded, can be subjected to a bending operation, the base portion can be bent to have a generally U-shaped cross-section. By virtue of the metallic insert embedded within the base portion, the gripping force of the base portion can be enlarged, and accordingly, the base portion with a generally U-shaped cross-section can grip a door member or a flange around a door opening in a motor vehicle. In addition, the weather strip can be attached to a curving area so as to conform thereto.

As described above, since the width ratio of the insert pieces, the first slits and the second slits in the longitudinal direction is determined to 100:(65~104):(24~53), the width of the first slits can be enlarged to decrease the number of the insert pieces per unit length, whereby the weight of the insert can be reduced, thereby contributing to the reduction in weight of the vehicle body. Since the width ratio of the first joining parts to the second joining parts in the width direction is determined to 20:(28~33), the first joining parts can be readily broken so that the insert can be separated with two insert pieces joined to each other and without being separated at the second joining parts.

There can be provided the method for readily producing long products, which includes the extruding step carried out without separating the insert, and the insert-separating step of readily separating only the first joining parts, thereby enlarging the gripping force of the attaching base portion.

Other objects, features, and characteristics of the present invention will become apparent upon consideration of the following description and the appended claims with reference to the accompanying drawings, all of which form a part of this specification.

DETAILED DESCRIPTION OF THE PREFERRED EMBODIMENTS

One embodiment of the present invention will be explained with reference to FIG. 5 through 12. The present invention will be explained with reference to a weather strip for a motor vehicle, but the present invention can be also applied to a long product provided with an insert in accordance with the present invention and formed by extrusion.

Figure 1:
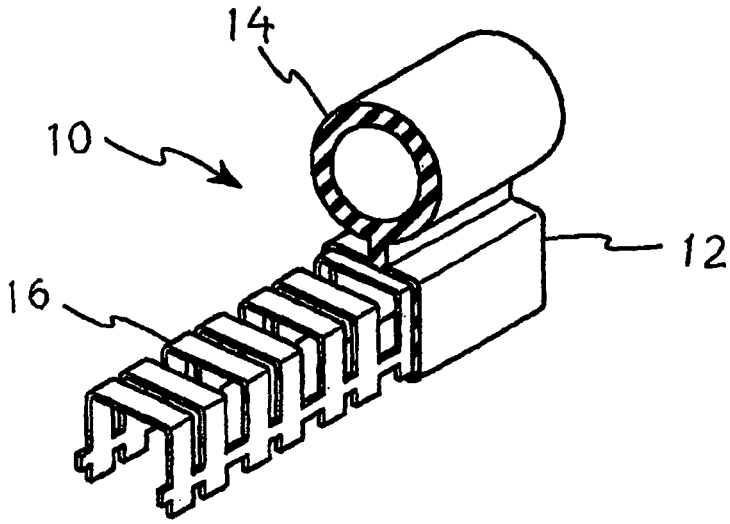
FIG. 1 PRIOR ART
FIG. 1 is a partially cut-away perspective view of a conventional weather strip and a conventional insert.
Figure 2:
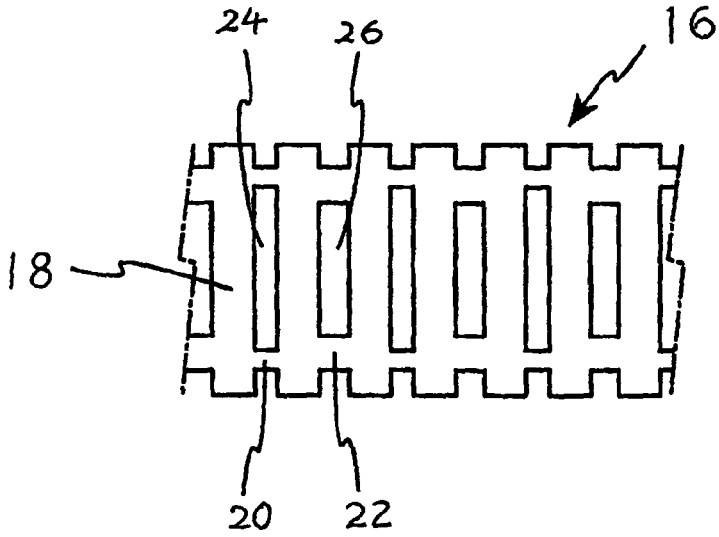
FIG. 2 PRIOR ART
FIG. 2 is a plan view of one portion of a conventional insert.
Figure 3:
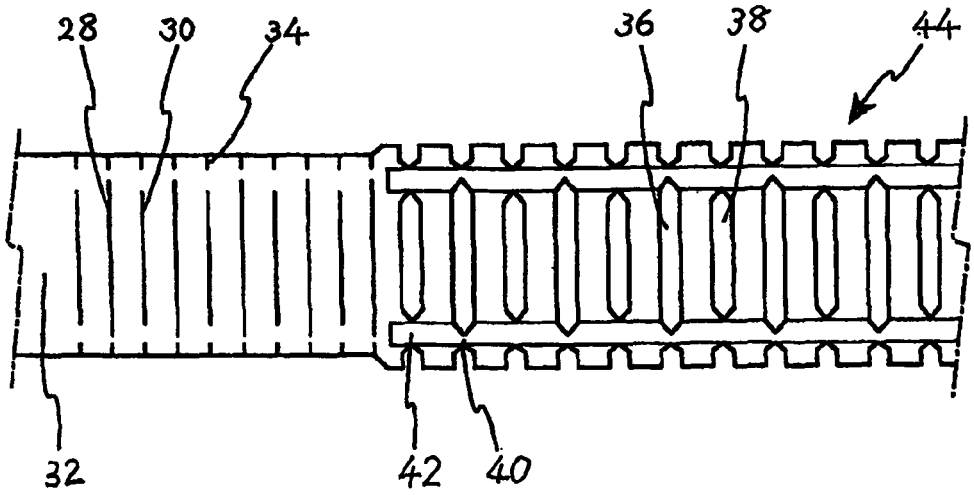
FIG. 3 PRIOR ART
FIG. 3 is a view showing a band-shaped metallic plate during the production steps of another conventional insert.
Figure 4:
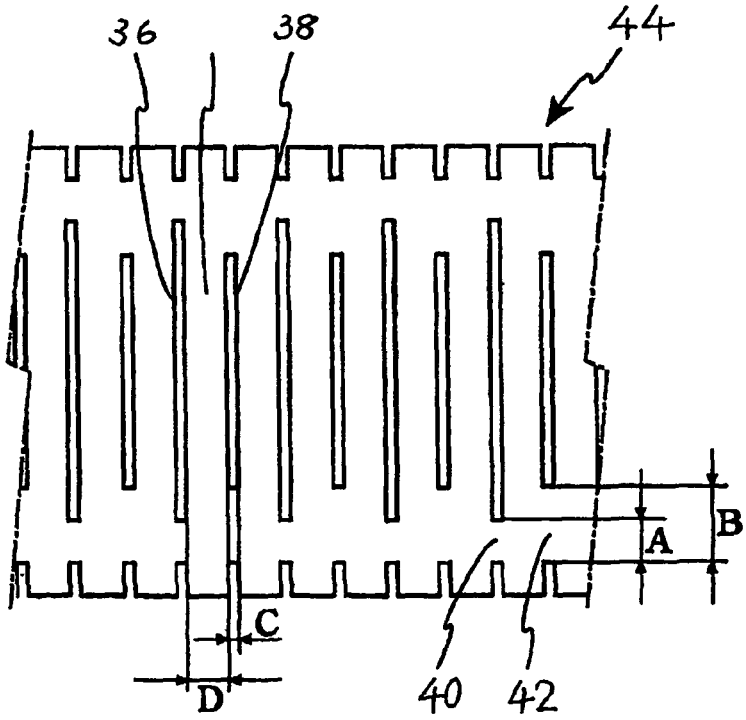
FIG. 4 PRIOR ART
FIG. 4 is a plan view of one portion of another conventional insert.
Figure 5:
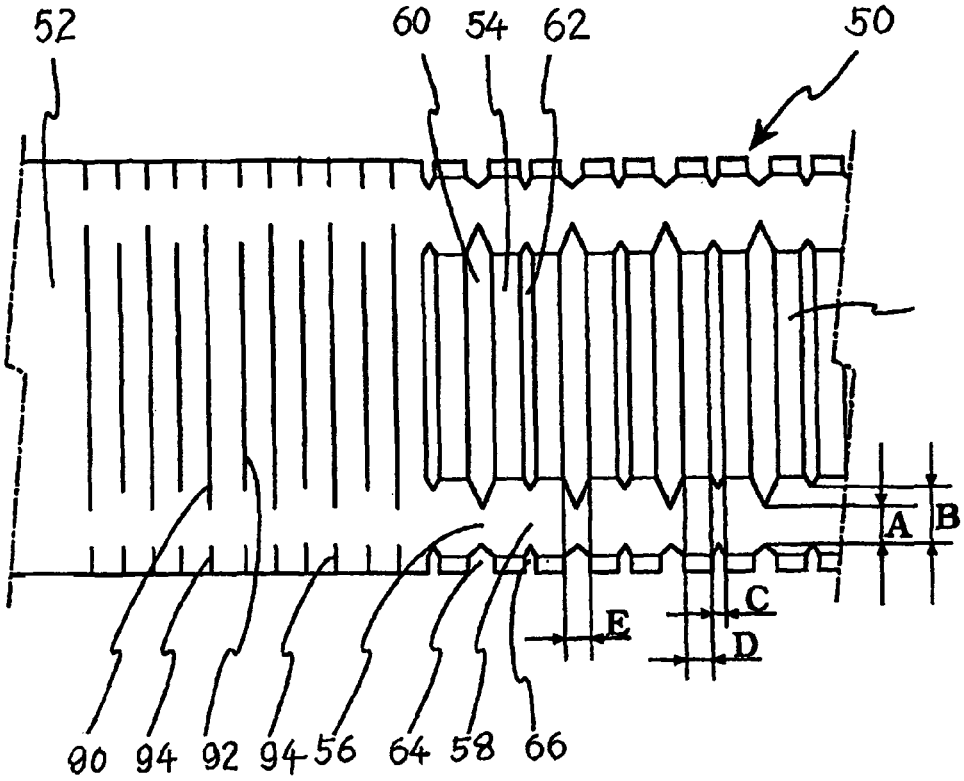
FIG. 5 is a partial plan view of an insert in accordance with the present invention, and a band-shaped metallic plate during the production steps thereof.
Figure 6:
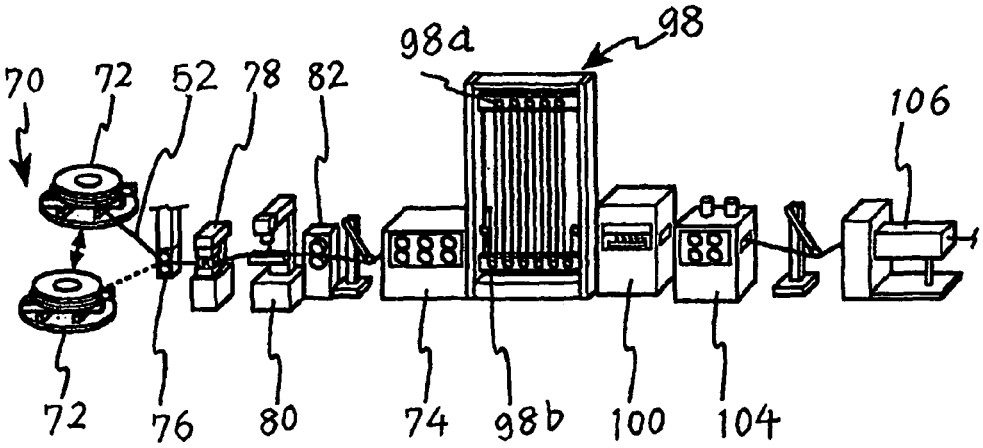
FIG. 6 is a schematic diagram showing the insert-processing step in the method in accordance with the present invention.
Figure 9:
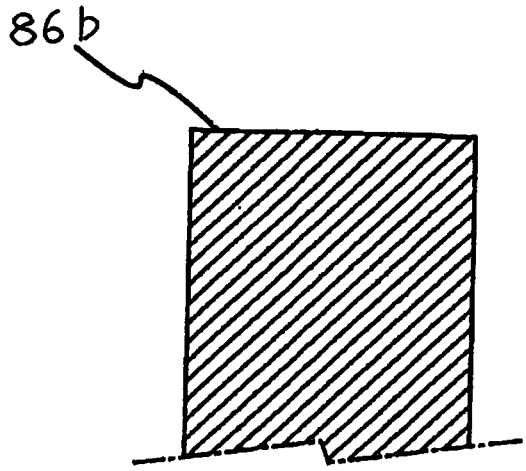
FIG. 9 is a partial sectional view of a rolling roll of an insert-producing machine in the method in accordance with the present invention, which shows a flat plane thereof.
Figure 10:
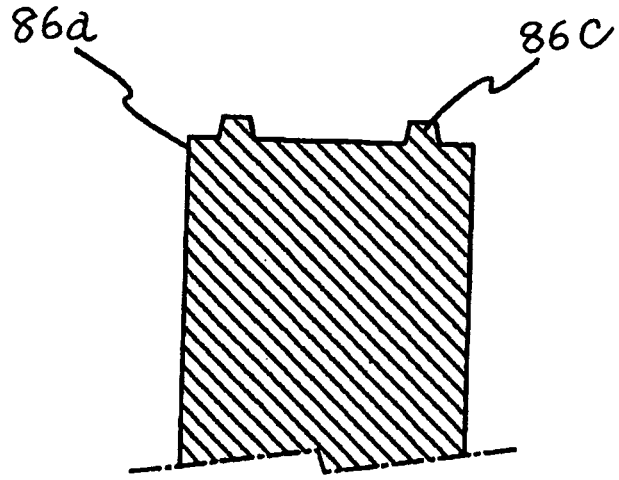
FIG. 10 is a partial sectional view of a rolling roll of an insert-producing machine in the method in accordance with the present invention, which shows projections thereof.
Figure 11:
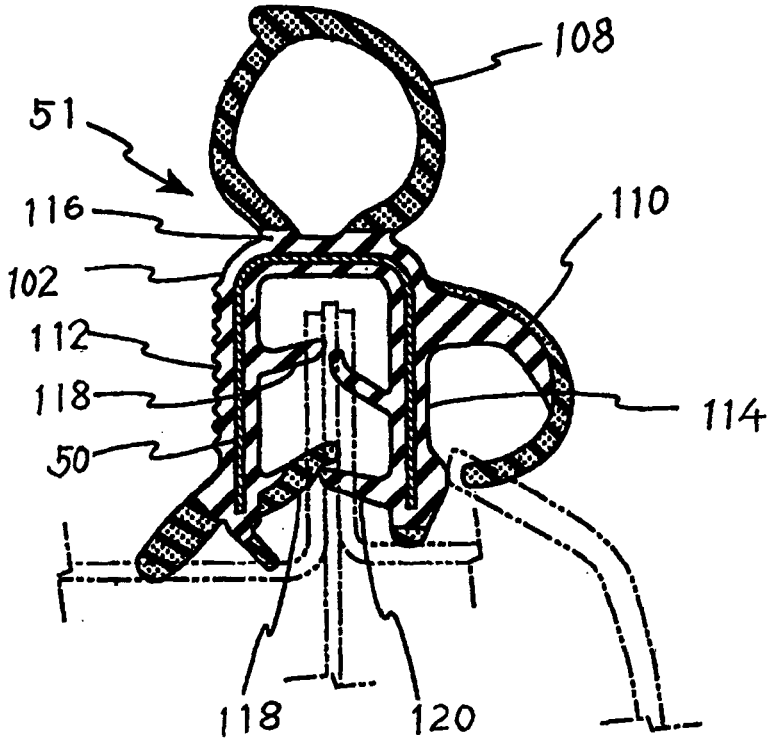
FIG. 11 is a sectional view of a weather strip for use in a motor vehicle, which is produced by one embodiment of the method in accordance with the present invention.
Figure 12:
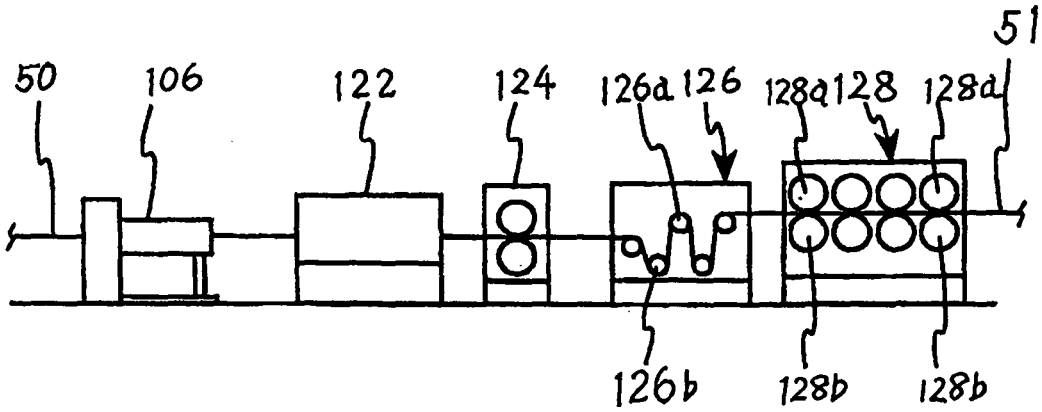
FIG. 12 is a schematic diagram of an extruding step of a weather strip in one embodiment of the method in accordance with the present invention.

FIG. 5 is a plan view showing an insert 50 in accordance with the present invention along with producing steps thereof, FIGS. 6 through 10 show the producing steps of the insert 50, FIG. 11 is a cross-sectional view of a weather strip 51 using the insert 50 in accordance with the present invention, and FIG. 12 is a schematic diagram showing the producing steps of the weather strip 51.

First, the insert 50 and the producing steps thereof will be explained, and next, the weather strip 51 and the producing steps thereof will be explained.

As shown in FIG. 5, the insert 50 is produced by processing a band-shaped metallic plate 52 and configured such that a large number of insert pieces 54 are respectively arranged in a width direction of the band-shaped metallic plate 52 and are joined to each other in a longitudinal direction of the band-shaped metallic plate 52 with joining parts provided along side edges of the insert pieces 54 into a ladder-like configuration.

The joining parts include first joining parts 56 with a smaller width shown by "A" in FIG. 5, which are provided along side ends of later describing first slits 60, and second joining parts 58 with a larger width shown by "B" in FIG. 5, which are provided along side ends of later describing second slits 62. The first joining parts 56 and the second joining parts 58 are alternately arranged in a longitudinal direction of the insert 50.

With this arrangement, after the insert 50 is embedded in the long product and extruded, only the first joining parts 56 formed thinner and narrower than the insert pieces 54 are readily broken, and consequently, the insert 50 can be separated with two insert pieces joined, whereby the flexibility of the long product and the rigidity of the insert 50 can be ensured.

The width ratio of the insert pieces 54, the first slits 60 and the second slits 62 in a longitudinal direction of the insert 50 is required to be determined to 100:(65~104):(24~53). Where the width of the first slits 60 is determined to 65~104 against that of the insert pieces 54, which is 100, the number of the insert pieces 54 per unit length can be reduced while enlarging the width of the first slits 60, and consequently, the weight of the insert 50 can be reduced to contribute to the reduction in weight of a vehicle body using the long product such as the weather strip, in which the insert 50 is embedded.

Where the ratio of the width of the first slits 60 in the longitudinal direction is less than 65 against that of the insert pieces 54, which is 100, the number of the insert pieces 54 per unit length cannot be reduced, and the weight of the insert 50 cannot be reduced. Where the ratio of the width of the first slits 60 in the longitudinal direction exceeds 104, the number of the insert pieces 54 per unit length decreases and the rigidity of the insert 50 is deteriorated, whereby the gripping force of the trim portion as a base portion of the long product, in which the insert 50 is embedded, lowers.

The ratio of the width of the second slits 62 in the longitudinal direction of the insert 50 is determined to 24~53 against that of the insert pieces 54, which is 100. Where the ratio of the width of the second slits 62 is less than 24, the number of the insert pieces 54 per unit length cannot be reduced. Where the ratio of the width of the second slits 62 exceeds 53, the strength of the second joining parts 66 of the insert 50 lowers so that in the separating step of the first joining parts 56, the second joining parts 58 may be broken.

It is preferable that the width ratio of the insert pieces 54, the first slits 60 and the second slits 62 in a longitudinal direction of the insert 50 is determined to 100:(75~95):(32~43). In this case, where the insert 50 is used in a long product, the insert 50 exhibits a sufficient gripping force, and the weight of the insert 50 can be reduced.

Where the width of the first slits 60 in the longitudinal direction is 75~95 against that of the insert pieces 54, which is 100, the number of the insert pieces 54 per unit length can be reduced, and the rigidity of the insert 50 can be securely effected, whereby the gripping force of the trim portion as the base portion of the long product, in which the insert 50 is embedded, can be ensured.

Where the width of the second slits 62 in the longitudinal direction is 32~43 against that of the insert pieces 54, which is 100, the number of the insert pieces 54 per unit length can be reduced, and the strength of the second joining parts 58 of the insert 50 can be ensured, whereby in the separating step of the first joining parts 56, the second joining parts 58 can be surely prevented from breaking.

In the present embodiment, the thickness ratio of the insert pieces 54, the first joining parts 56 and the second joining parts 58 is determined to 20:(10~13). With this arrangement, since the first joining parts 56 and the second joining parts 58 are elongated in the longitudinal direction by applying the rolling operation and a tension force, the width of the first slits 60 can be made greater than that of the second slits 62. And the first joining parts 56 are readily breakable so that after the insert 50 is embedded in the long product and extruded, the first joining parts 56 can readily break.

First depressions 64 and second depressions 66 can be formed on outer sides of the first joining parts 56 facing the first slits 60, and the second joining parts 58 facing the second slits 62, respectively. With this arrangement, the width of the first joining parts 56 and the second joining parts 58 are defined to facilitate the application of the rolling operation and a tension force.

Where the ratio of the thickness of the first joining parts 56 and the second joining parts 58 is less than 10 to that of the insert pieces 54, which is 20, the strength of the first joining parts 56 and the second joining parts 58 becomes short so that in the extruding step, the first joining parts 56 may be broken, and in the separating step of the insert 50, the second joining parts 58 may be broken. Where the ratio of the thickness of the first joining parts 56 and the second joining parts 58 exceeds 13 against the thickness of the insert pieces 54, which is 20, the strength of the first joining parts 56 and the second joining parts 58 becomes great so that in the insert separating step, the first joining parts 56 may be not broken.

In the present embodiment, where the length of the insert 50 in a width direction thereof is 28 mm, and the thickness of the insert pieces 54 is 0.45 mm, the width of the first joining parts 56 (shown by "A" in FIG. 5) can be determined to 2.4~2.6 mm, and specifically, 2.5 mm. Therefore, the first joining parts 56 can have a predetermined rigidity so as not to be broken in the extruding step of the long product such as a weather strip, etc. The width of the second joining parts 58 (shown by "B" in FIG. 5) can be determined to 3.7~3.9 mm, and specifically, 3.8 mm. The first joining parts 56 and the second joining parts 58 can be also formed by varying the dimensions thereof arbitrarily in the range of 20:(28~33).

In the present embodiment, the width of the insert pieces 54 of the insert 50 in the longitudinal direction thereof (shown by "D" in FIG. 5) is 2.3 mm, the length of the insert 50 in the width direction thereof (the entire length in the width direction inclusive of the insert pieces 54) is about 28 mm.

The width "D" can be determined to the range from 2.05 mm to 2.55 mm, and preferably the range from 2.2 mm to 2.4 mm. And the length of each insert piece 54 can be determined to the range from 26 mm to 48 mm.

In the present embodiment, the width of the first slits 60 is about 1.9 mm. The width of the first slits 60 can be determined to the range from 1.65 mm to 2.15 mm, and preferably the range from 1.8 mm to 2.1 mm.

The width of the second slits 62 is about 0.85 mm. The width of the second slits 62 can be determined to the range from 0.60 mm to 1.10 mm, and preferably the range from 0.75 mm to 0.95 mm. In the present embodiment, the insert pieces 54, the first slits 60 and the second slits 62 are formed in the above-described ranges, but they can be formed with dimensions in the ratio of 100:(65~104):(24~53).

Both side edges of the insert pieces 54 are joined to each other with the first joining parts 56 and the second joining parts 58 so that when the insert 50 with a ladder-shaped configuration is fed to an extruder and extruded along with a rubber-like elastic material, side ends of each insert piece 54 are prevented from irregularly bending. Therefore, the rubber-like elastic material and the insert 50 can be smoothly fed to the extruder, thereby facilitating the extrusion.

The first joining parts 56 and the second joining parts 58 are produced by applying a rolling operation and a tension force. Therefore, when the band-shaped metallic plate 52 is processed, waste metal is not produced, and the first slits 60 and the second slits 62 can be produced between adjacent insert pieces 54. In addition, the joining parts can be formed thinner than the remaining parts (central portions of the insert pieces 54). And since a tension force is applied, too, the first joining parts 56 can be formed narrower than the second joining parts 58. Therefore, in the insert separating step after the insert 50 is embedded in the weather strip 51 and extruded, only the first joining parts 56 that are thinner and narrower can be readily broken with the second joining parts 58 unbroken.

In the present embodiment, the band-shaped metallic plate 52 has a thickness of 0.45 mm before rolling, and a thickness of 0.23 mm after rolling. There can be used a band-shaped metallic plate having a thickness ranging from 0.35 mm to 0.55 mm before rolling, and having a thickness in joining parts after rolling, which ranges from 0.15 mm to 0.35 mm.

Where the width of the first slits 60 is less than 1.65 mm, the number of the insert pieces 54 per unit length increases so as not to contribute to the reduction in weight of a vehicle body, whereas where the width of the first slits 60 is greater than 2.15 mm, the rolling operation is performed excessively so that the joining parts break, and consequently, the production of the insert 50 may become impossible. In addition, where the width of the second slits 62 is less than 0.60 mm, it is impossible to contribute to the reduction in weight of a vehicle body, whereas where the width of the second slits 62 is greater than 1.10 mm, the rolling operation proceeds excessively so that the second joining parts 58 may break, too.

In addition, where the thickness of the band-shaped metallic plate 52 is less than 0.33 mm, the rolling operation proceeds excessively so that the joining parts become readily broken, and consequently, they may break in another step than the step required to break, whereas when the thickness of the band-shaped metallic plate 52 is greater than 0.55 mm, it is impossible to contribute to the reduction in weight of a vehicle body.

Next, the method for producing the insert 50 will be explained with reference to FIGS. 6 through 10.

In order to produce the insert 50, the band-shaped metallic plate 52 is pulled from a band-shaped metallic plate feeder 70 provided with a rotary reel 72 around which the band-shaped metallic plate 52 is wound to an insert processing machine 74 by way of an end detector 76, an end cutter 78, an automatic welding machine 80 and an automatic annealing machine 82, and is mounted on each machine. The end detector 76, the end cutter 78, the automatic welding machine 80. and the automatic annealing machine 82 do not operate until the feeding of the band-shaped metallic plate 52 from one rotary reel 72 is finished, and allow the passing of the band-shaped metallic plate 52.

The band-shaped metallic plate 52 fed to the insert processing machine 74 is processed therewith from a long band-shaped metallic plate to the above-described insert 50 shown in FIG. 5.

Figure 7:
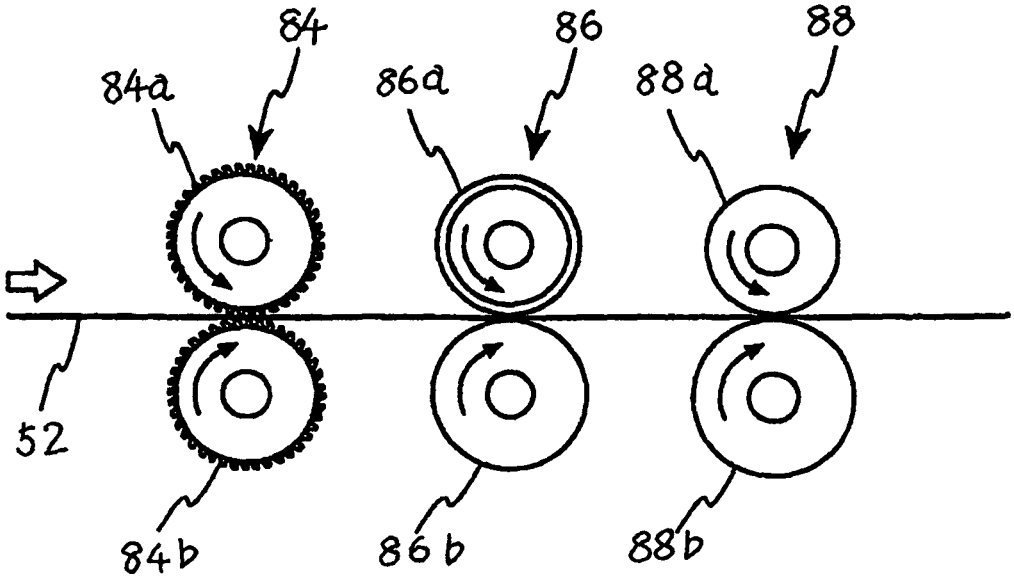
FIG. 7 is a schematic diagram showing the insert-processing step in an interior of an insert-processing machine in the method in accordance with the present invention.

As shown in FIG. 7, the insert processing machine 74 includes a slitter roll 84 adapted to form cut lines in the band-shaped metallic plate 52, a rolling roll 86 adapted to roll uncut portions, and a take-up roll 88 adapted to take up the band-shaped metallic plate 52.

As shown in FIG. 5, with the slitter roll 84 adapted to form cut lines in the band-shaped metallic plate 52, first cut lines 90, each having a large length in a width direction of the plate 52, and second cut lines 92, each having a small length in the width direction, are alternately formed in a central portion of the plate 52 with the exception of side portions thereof. And on both sides of the first cut lines 90 and the second cut lines 92, side cut lines 94 are formed along side edges of the band-shaped metallic plate 52 by a small length.

In the present embodiment, the width of the band shaped metallic plate 52 is 28 mm, the length of the first cut lines 92 is 20.6 mm, the length of the second cut lines 94 is 18.0 mm and the length of the side cut lines is about 1.2 mm.

Figure 8:
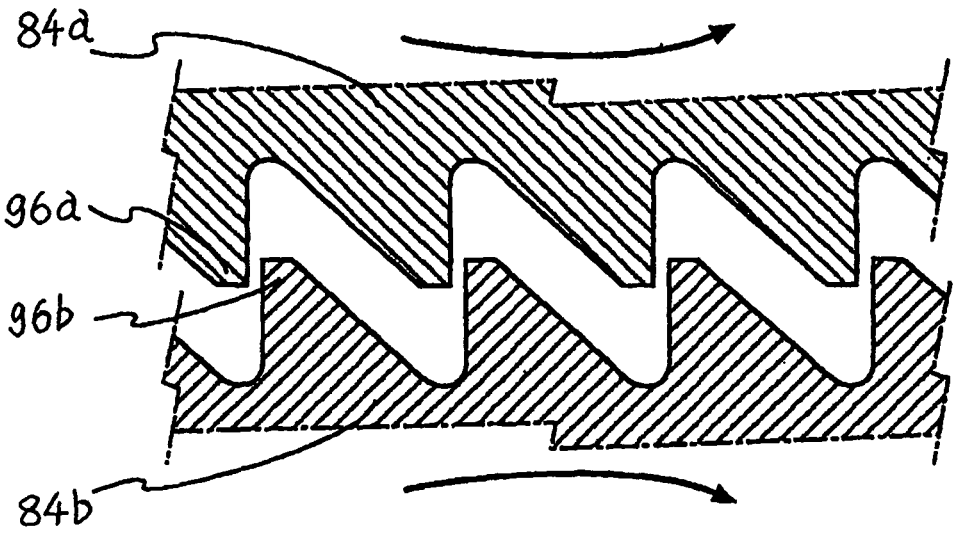
FIG. 8 is a partial sectional view of a slitter roll of an insert-processing machine in the method in accordance with the present invention.

As shown in FIGS. 7 and 8, the slitter roll 84 includes a first slitter roll 84*a* and a second slitter roll 84*b* which sandwich the band-shaped metallic plate 52 on the upper side and the lower side thereof. First slitter teeth 96*a* provided along an outer periphery of the first slitter roll 84*a*, and second slitter teeth 96*b* provided along an outer periphery of the second slitter roll 84*b* shear the band-shaped metallic plate 52 to form cut lines. The first slitter teeth 96*a* and the second slitter teeth 96*b* are provided to have lengths in a width direction of the slitter rolls 86*a* and 86*b*, which correspond to those of the first slits 60 and the second slits 62.

And uncut parts are rolled with the rolling roll 86. As shown in FIGS. 9 and 10, the rolling roll 86 includes a protruding roll 86*a* and a flat roll 86*b*. The protruding roll 86 is provided with protrusions 86*c* in areas corresponding to the uncut portions, and the flat roll 86*b* is provided with a flat circumferential surface. The protruding roll 86*a* and the flat roll 86*b* sandwich the band-shaped metallic plate 52 to roll the uncut portions, thereby forming the first joining parts 56 and the second joining parts 58.

Next, the band-shaped metallic plate 52 is taken up with the take-up roll 88. The take-up roll 88 includes an upper roll 88*a* and a lower roll 88*b*. They strongly sandwich the band-shaped metallic plate 52, and take up the same. At this time, the feeding speed (rotating speed) of the take-up roll 88 is made greater than that of the rolling roll 86 so that a tension force of 200 through 250 N is applied to the band-shaped metallic plate 52 rolled with the rolling roll 86.

As a result, uncut portions of the band-shaped metallic plate 52, that is the first joining parts 56 and the second joining parts 58 as the joining parts of the insert 50, are rolled. At the same time, such a force as to enlarge the width of the first slits 60 and the second slits 62 in a longitudinal direction of the insert 50 is applied, but, the first slits 60 are enlarged, whereas the second slits 62 are merely enlarged slightly. Namely, where the tension force is less than 200 N, the first slits 60 merely open slightly, and where the tension force exceeds 250 N, the second slits 62 open too much. It is preferable for reducing the weight of the insert 50 that the second slits 62 open, but in this case, it becomes difficult to separate the insert 50 at prescribed positions (first joining parts 56).

The insert 50 thus processed is fed to an insert accumulator 98. In the insert accumulator 98, the band-shaped insert 50 is accumulated between rotary rolls 98*a* and 98*b*, which are alternately provided on the upper side and the lower side of the insert accumulator 98 in a zigzag configuration. These rotary rolls 98*a* and 98*b* are attached so as to be rotatable and moveable upwardly and downwardly. With this arrangement, the accumulating length of the insert 50 can be adjusted by moving the rotary rolls 98*a* and 98*b* upwardly and downwardly while feeding the insert 50.

The insert 50 is fed from the insert accumulator 98 to a degreasing device 100. The degreasing device 100 removes oils and fats adhered to surfaces of the insert 50. With this degreasing step, the adhesion properties of a covering layer composed of a rubber-like elastic material such as synthetic resin and thermoplastic elastomer, which is extruded to define a trim portion 102 of a weather strip 51, against the insert 50 is improved, thereby improving the durability and appearance of the trim portion 102.

Next, the insert 50 fed out of the degreasing device 100 is fed to a pre-forming machine 104. With this pre-forming machine 104, the weather strip 51 is slightly bent into a saddle-like configuration. By virtue of this pre-forming step, a tubular seal portion 108 and a cover lip 110 are prevented from interfering with each other upon extruding the weather strip 51, and silicon films, etc., which are adapted to improve the abrasion resistance of surfaces of the weather strip 51, can be readily applied thereto.

Hereinafter, the weather strip 51 as a long product using the above-described insert 50 will be explained with reference to FIG. 11. FIG. 11 is a cross-sectional view of the weather strip 51. The weather strip 51 has the trim portion 102 as a base portion for attachment to a flange formed along an opening portion of a vehicle body, etc., the tubular seal portion 108 and the cover lip 110.

The trim portion 102 includes an outer side wall 112, an inner side wall 114 and a bottom wall 116, and has a generally U-shaped cross-section. The insert 50 is embedded within the trim portion 102, and the cover lip 110 is provided in an upper part of the trim portion 102 so as to extend into a vehicle compartment. This cover lip 110 may be locally cut away in predetermined areas thereof. With the insert 50, the rigidity of the trim portion 102 is enhanced so that the trim portion 102 can be securely attached to flanges of the vehicle body and the door, Then, the insert 50 is separated in the first joining parts 56 to enhance the flexibility of the weather strip 51 while keeping the gripping force of the trim portion 102. Two outer holding lips 118 and two inner holding lips 120 are provided in an interior of the trim portion 102. A flange provided in a door or a door opening portion is inserted in the interior of the trim portion 102, and held with the outer holding lips 118 and the inner holding lips 120, whereby the weather strip 51 is attached.

The tubular seal portion 108 is integrally formed on an outer surface of the bottom wall 116.

The trim portion 102 is composed of a solid material or finely foaming material of a rubber-like elastic material such as rubber, a thermoplastic elastomer, a soft synthetic resin, etc., whereas the tubular seal portion 108 is composed of a sponge material of a rubber-like elastic material such as rubber, a thermoplastic elastomer, etc.

Next, the producing method of the weather strip 51 as a long product using the insert 50 thus prepared will be explained with reference to FIG. 12.

FIG. 12 is a schematic diagram showing the producing steps of the weather strip 51.

The insert 50 thus prepared is fed to an extruder 106, similarly to the conventional method, and is covered with a covering layer composed of a rubber-like elastic material such as synthetic rubber, a thermoplastic elastomer, etc., thereby forming the trim portion 102 and the tubular seal portion 108. As a result, the weather strip 51 is prepared. Then, in the case that the covering layer is composed of rubber, the weather strip 51 is fed to a vulcanizing chamber 122, and heated and vulcanized with a hot air, ultra high frequency wave, etc. It is preferable that the trim portion 102 is composed of a solid material, whereas the tubular seal portion 108 is composed of a sponge material.

The weather strip 51 thus vulcanized is taken up with a take-up machine 124. Then, in order to improve the flexibility of the weather strip 51, only the first joining parts 56 of the insert 50 are broken with an insert separating machine 126.

The insert separating machine 126 includes a plurality of upper separating rolls 126*a* and a plurality of lower separating rolls 126*b*. The insert separating machine 126 operates to pass the weather strip 51 between the upper separating rolls 126*a* and the lower separating rolls 126*b* in a zigzag configuration, thereby bending the weather strip 51 repeatedly, and breaking the first joining parts 56 of the insert 50 due to metal fatigue thereof. As a result, the insert 50 is separated.

The weather strip 51 in which the first joining parts 56 of the insert 50 are broken, is fed to a bending machine 128, and bent with upper bending rolls 128*a* and lower bending rolls 128*b* so as to have a generally U-shaped cross-section shown in FIG. 11. The weather strip 51 thus bent is subjected to the cutting operation, etc., and ends thereof is subjected to the molding operation, similarly to the conventional method. As a result, the weather strip 51 as the product is obtained.

While the invention has been described in connection with what are considered to be the preferred embodiments, it is to be understood that the invention is not limited to the disclosed embodiments, but, on the contrary, is intended to cover various modifications and equivalent arrangements included within the spirit and scope of the appended claims.

What is claimed is:

1. An insert formed by processing a band-shaped metallic plate, and adapted to be embedded within a long product, wherein said insert includes a large number of insert pieces, each having a rectangular configuration and extending in a width direction of said band-shaped metallic plate, said insert pieces are joined with joining parts in a longitudinal direction of said band-shaped metallic plate at both sides of said insert pieces into a ladder-shaped configuration, a rolling operation and a tension force are applied to said joining parts, said insert pieces define slits between adjacent insert pieces, said slits include first slits, each having a large width in a longitudinal direction of said insert, and second slits, each having a width smaller than that of said first slits in said longitudinal direction, said first slits and said second slits are alternately arranged in said longitudinal direction, said joining parts include first joining parts, each being formed on a side of each of said first slits and having a small width in a width direction of said insert, and second joining parts, each being formed on a side of each of said second slits and having a width larger than that of said first joining parts in said width direction, said first joining parts and said second joining parts are alternately arranged in said longitudinal direction, the width ratio of said insert pieces, said first slits and said second slits in said longitudinal direction is determined to 100:(65~104):(24~53), and the width ratio of said first joining parts to said second joining parts in said width direction is determined to 20:(28~33).

2. An insert as claimed in claim 1, wherein the width ratio of said insert pieces, said first slits and said second slits in said longitudinal direction is determined to 100:(75~95):(32~43), and the width ratio of said first joining parts to said second joining parts in said width direction is determined to 20:(28~33).

3. An insert as claimed in claim 1, wherein the ratio of the thickness of said insert pieces to that of said joining parts is determined to 20:(10~13).

4. A method for producing an insert formed by processing a band-shaped metallic plate so as to include insert pieces, each having a rectangular configuration and defining slits with adjacent insert pieces, and joining parts joining both side ends of said insert pieces into a ladder-shaped configuration, and adapted to be embedded within a long product, comprising the steps of:

forming long cut lines and short cut lines alternately in a longitudinal direction of said band-shaped metallic plate with the exception of side edges thereof so as to extend in a width direction thereof;

feeding said band-shaped metallic plate including said long cut lines and said short cut lines to rolling rolls and take-up rolls; and applying a rolling operation and a taking-up operation to said side edges of said band-shaped metallic plate in which said cut lines are not formed, thereby forming slits between adjacent insert pieces, and said joining parts, wherein said slits include first slits, each having a large width in a longitudinal direction of said insert, and second slits, each having a width smaller than that of said first slits in said longitudinal direction such that said first slits and said second slits are alternately arranged in said longitudinal direction, said joining parts include first joining parts, each being formed on a side of each of said first slits and having a small width in a width direction of said insert, and second joining parts, each being formed on a side of each of said second slits and having a width larger than that of said first joining parts in said width direction, and said first joining parts and said second joining parts are alternately formed in said longitudinal direction with said rolling operation and a tension force generated due to difference in rotation speed between said rolling rolls and said take-up rolls such that the width ratio of said insert pieces, said first slits and said second slits in said longitudinal direction is determined to 100:(65~104):(24~53), and the width ratio of said first joining parts to said second joining parts in said width direction is determined to 20:(28~33).

5. A method for producing an insert as claimed in claim 4, wherein said insert is formed such that the width ratio of said insert pieces, said first slits and said second slits in said longitudinal direction is determined to 100:(75~95):(32~43), and the width ratio of said first joining parts to said second joining parts in said width direction is determined to 20:(28~33).

6. A method for producing an insert as claimed in claim 4, wherein said insert is formed such that the ratio of the thickness of said insert pieces to that of said joining parts is determined to 20:(10~13).

7. A method for producing an insert as claimed in claim 4, wherein said insert fed to said rolling rolls is taken up with a tension force of 200 through 250 N by increasing the feeding speed of said take-up rolls greater than that of said rolling rolls.

8. A method for producing a long product comprising an insert-processing step of processing a band-shaped metallic plate to form a metallic insert, an extruding step of feeding said metallic insert to an extruder, and covering said insert with a rubber-like elastic material to form a covering layer such that said insert is embedded within said long product, and an insert-separating step of separating insert pieces of said insert, wherein in said insert-processing step, long cut lines and short cut lines are formed alternately with the exception of side edges of said band-shaped metallic plate so as to extend in a width direction thereof, said band-shaped metallic plate including said long cut lines and said short cut lines is fed to rolling rolls and take-up rolls, a rolling operation and a taking-up operation are applied to said side edges of said band-shaped metallic plate in which said cut lines are not formed, thereby forming slits between adjacent insert pieces, and joining parts, said slits including first slits, each having a large width in a longitudinal direction of said insert, and second slits, each having a width smaller than that of said first slits in said longitudinal direction such that said first slits and said second slits are alternately formed in said longitudinal direction, and said joining parts including first joining parts, each being formed on a side of each of said first slits and having a small width in a width direction of said insert, and second joining parts, each being formed on a side of each of said second slits and having a width larger than that of said first joining parts in said width direction such that said first joining parts and said second joining parts are alternately formed in said longitudinal direction with said tension force generated due to difference in rotation speed between said rolling rolls and said take-up rolls, and the width ratio of said insert pieces, said first slits and said second slits in said longitudinal direction is determined to 100:(65~104):(24~53), whereas the width ratio of said first joining parts to said second joining parts in said width direction is determined to 20:(28~33), in said extruding step, said insert is fed to said extruder and covered with said rubber-like elastic material to form said covering layer such that said insert is embedded within a base portion of said long product, and said insert covered with said covering layer is fed to said insert-separating step, and in said insert-separating step, said insert is separated at positions corresponding to said first slits such that two insert pieces join to each other.

9. A method for producing a long product as claimed in claim 8, wherein said insert is formed such that the width ratio of said insert pieces, said first slits and said second slits in said longitudinal direction is determined to 100:(75~95):(32~43), and the width ratio of said first joining parts to said second joining parts in said width direction is determined to 20:(28~33).

10. A method for producing a long product as claimed in claim 8, wherein said insert is formed such that the ratio of the thickness of said insert pieces to that of said joining parts is determined to 20:(10~13).

11. A method for producing a long product as claimed in claim 8, wherein said long product is a weather strip adapted to provide a seal around an opening portion in a vehicle body.

* * * * *